US007000589B2

(12) United States Patent
Matthews et al.

(10) Patent No.: US 7,000,589 B2
(45) Date of Patent: Feb. 21, 2006

(54) DETERMINING MANIFOLD PRESSURE BASED ON ENGINE TORQUE CONTROL

(75) Inventors: Gregory P. Matthews, West Bloomfield, MI (US); Michael Livshiz, Ann Arbor, MI (US)

(73) Assignee: General Motors Corporation, Detroit, MI (US)

( * ) Notice: Subject to any disclaimer, the term of this patent is extended or adjusted under 35 U.S.C. 154(b) by 39 days.

(21) Appl. No.: 10/868,205

(22) Filed: Jun. 15, 2004

(65) Prior Publication Data

US 2005/0274357 A1 Dec. 15, 2005

(51) Int. Cl.
*F02D 41/18* (2006.01)

(52) U.S. Cl. ..... 123/350; 123/399; 123/361; 123/480; 701/104; 73/118.2

(58) Field of Classification Search ..... 123/350, 123/361, 399, 480, 488; 73/118.1, 118.2; 701/104, 114–115
See application file for complete search history.

(56) References Cited

U.S. PATENT DOCUMENTS

| | | | | |
|---|---|---|---|---|
| 545,617 | A | 9/1895 | Tynes | |
| 4,996,959 | A * | 3/1991 | Akimoto | 123/406.52 |
| 5,423,208 | A | 6/1995 | Dudek et al. | |
| 5,497,329 | A * | 3/1996 | Tang | 701/104 |
| 5,753,805 | A * | 5/1998 | Maloney | 73/118.2 |
| 6,250,292 | B1 * | 6/2001 | Suhre | 123/688 |
| 6,308,671 | B1 * | 10/2001 | Reed et al. | 123/90.15 |
| 6,636,796 | B1 * | 10/2003 | Kolmanovsky et al. | 701/104 |
| 6,662,640 | B1 * | 12/2003 | Yagi | 73/118.2 |
| 6,840,215 | B1 * | 1/2005 | Livshiz et al. | 123/352 |

* cited by examiner

*Primary Examiner*—Hai Huynh
(74) *Attorney, Agent, or Firm*—Christopher DeVries

(57) ABSTRACT

A torque control system for an engine includes a throttle plate having an adjustable throttle position to regulate a first mass air flow into the engine. A control module determines a first mass air flow into the engine and monitors an engine speed. The control module calculates a volumetric efficiency of the engine based on the first mass air flow and the engine speed and calculates the desired MAP based on the volumetric efficiency.

25 Claims, 2 Drawing Sheets

DETERMINING MANIFOLD PRESSURE BASED ON ENGINE TORQUE CONTROL

CROSS-REFERENCE TO RELATED APPLICATIONS

This application is related to U.S. Application Serial No. 10/868,192, filed Jun. 15, 2004, entitled, "Determining Manifold Pressure Based on Engine Torque Control". The disclosure of the above application is incorporated herein by reference.

FIELD OF THE INVENTION

The present invention relates to engine torque control, and more particularly to determining manifold pressure based on engine torque control.

BACKGROUND OF THE INVENTION

Internal combustion engine control systems have been developed as steady-state, torque-based control systems. In a torque-based control system, the desired torque output of the engine is indicated by a driver input. More specifically, a driver adjusts a position of an accelerator pedal, which provides an engine torque request. The throttle is controlled to regulate air flow into the engine that provides the desired engine torque output.

Torque-based control systems determine the mass of air needed to produce the desired engine torque and determine throttle position, exhaust gas recirculation (EGR) valve position and cam phase angles based on the mass of air. Traditionally, the throttle position is commanded directly as a function of the accelerator pedal position. Commonly assigned U.S. patent application Ser. No. 10/664,172, filed on Sep. 17, 2003 and entitled Engine Torque Control with Desired State Estimation describes a method which uses the manifold filling dynamics and can initially command the throttle to a value greater than the steady-state value. As the manifold fills with air the, throttle is brought back to the steady-state position. This results in an a more aggressive partial throttle acceleration, but may lead to an unexpected feel of the vehicle to the driver by not producing the expected behavior of the throttle to a step-in change in the accelerator pedal.

SUMMARY OF THE INVENTION

Accordingly, the present invention provides a torque control system for an engine. The torque control system includes a throttle plate having an adjustable throttle position to regulate a first mass air flow into the engine. A control module determines a first mass air flow into the engine and monitors an engine speed. The control module calculates a volumetric efficiency of the engine based on the first mass air flow and the engine speed and calculates the desired MAP based on the volumetric efficiency.

In other features, the volumetric efficiency is further based on calibration coefficients. The calibration coefficients are determined based on the engine speed and the first mass air flow.

In another feature, the torque control system further includes an inlet cam shaft that regulates air flow into a cylinder of the engine. The volumetric efficiency is further based on a phase angle of the inlet cam shaft.

In another feature, the torque control system further includes an exhaust cam shaft that regulates an exhaust flow from a cylinder of the engine. The volumetric efficiency is further based on a phase angle of the outlet cam shaft.

In still other features, the desired MAP is further based on the first mass air flow. The desired MAP is further based on a temperature of the first mass air flow.

In yet another feature, the torque control system further includes an exhaust gas recirculation (EGR) system that regulates a second mass air flow into the engine. The desired MAP is further determined based on the second mass air flow.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
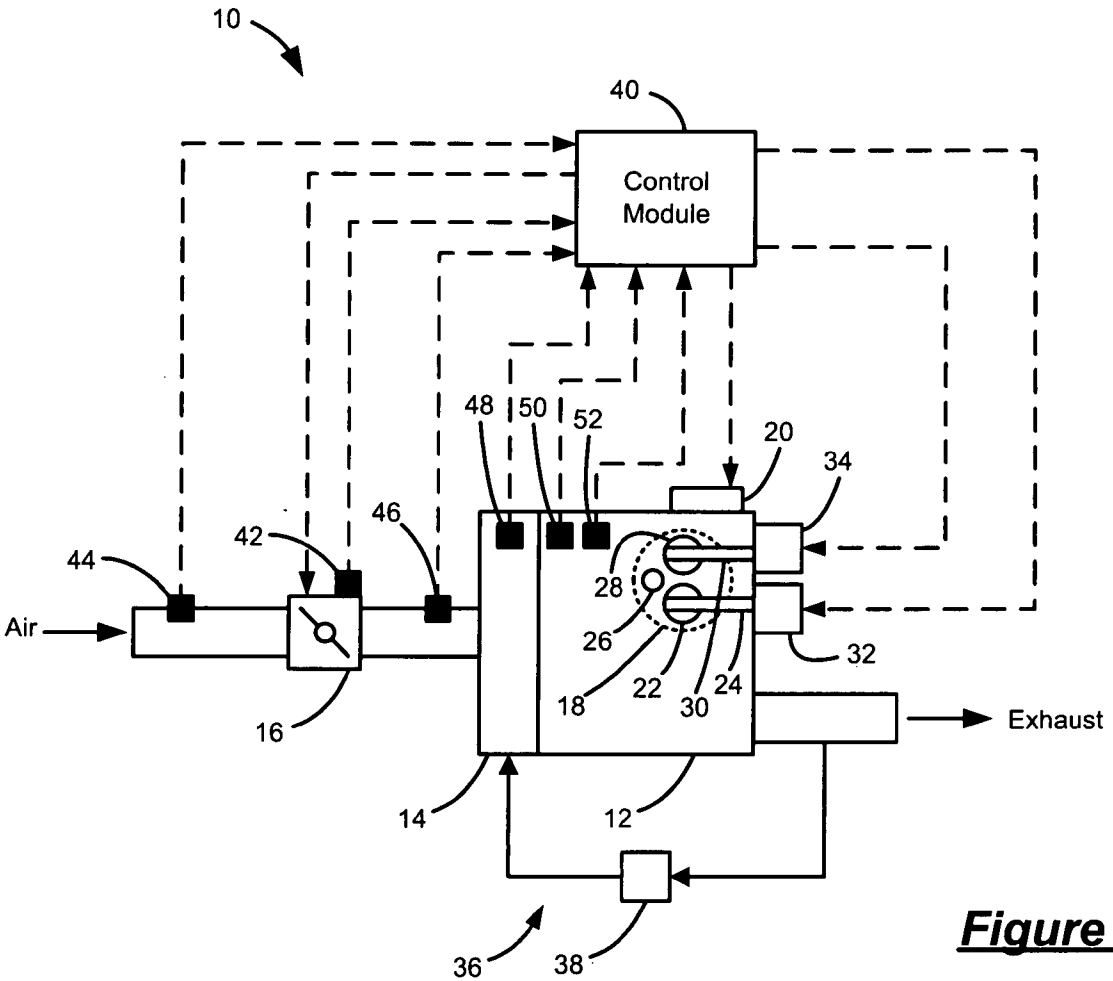
FIG. 1 is a schematic illustration of an exemplary engine system that is operated based on the engine torque control system according to the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an engine system 10 includes an engine 12 that combusts an air and fuel mixture to produce drive torque. Air is drawn into an intake manifold 14 through a throttle 16. The throttle 16 regulates mass air flow into the intake manifold 14. Air within the intake manifold 14 is distributed into cylinders 18. Although a single cylinder 18 is illustrated, it is appreciated that the engine torque control system of the present invention can be implemented in engines having a plurality of cylinders including, but not limited to, 2, 3, 4, 5, 6, 8, 10 and 12 cylinders.

A fuel injector (not shown) injects fuel which is combined with the air as it is drawn into the cylinder 18 through an intake port. The fuel injector may be an injector associated with an electronic or mechanical fuel injection system 20, a jet or port of a carburetor or another system for mixing fuel with intake air. The fuel injector is controlled to provide a desired air-to-fuel (A/F) ratio within each cylinder 18.

An intake valve 22 selectively opens and closes to enable the air/fuel mixture to enter the cylinder 18. The intake valve position is regulated by an intake cam shaft 24. A piston (not shown) compresses the air/fuel mixture within the cylinder 18. A spark plug 26 initiates combustion of the air/fuel mixture, driving the piston in the cylinder 18. The piston drives a crankshaft (not shown) to produce drive torque.

Combustion exhaust within the cylinder 18 is forced out an exhaust port when an exhaust valve 28 is in an open position. The exhaust valve position is regulated by an exhaust cam shaft 30. The exhaust is treated in an exhaust system and is released to atmosphere. Although single intake and exhaust valves 22,28 are illustrated, it is appreciated that the engine 12 can include multiple intake and exhaust valves 22,28 per cylinder 18.

The engine system 10 can include an intake cam phaser 32 and an exhaust cam phaser 34 that respectively regulate the rotational timing of the intake and exhaust cam shafts 24,30. More specifically, the timing or phase angle of the respective intake and exhaust cam shafts 24,30 can be retarded or advanced with respect to each other or with respect to a location of the piston within the cylinder 18 or crankshaft position. In this manner, the position of the intake and exhaust valves 22,28 can be regulated with respect to each other or with respect to a location of the piston within the cylinder 18. By regulating the position of the intake valve 22 and the exhaust valve 28, the quantity of air/fuel mixture ingested into the cylinder 18 and therefore the engine torque is regulated.

The engine system 10 can also include an exhaust gas recirculation (EGR) system 36. The EGR system 36 includes an EGR valve 38 that regulates an exhaust flow back into the intake manifold 14. The EGR system is generally implemented to regulate emissions. However, the mass of exhaust air that is recirculated back into the intake manifold 14 affects engine torque output.

A control module 40 operates the engine based on the engine torque control of the present invention. More specifically, the control module 40 generates a throttle control signal based on an engine torque request ($T_{REQ}$) and a throttle position signal generated by a throttle position sensor (TPS) 42. $T_{REQ}$ is generated based on a driver input such as an accelerator pedal position. The control module commands the throttle to a steady-state position to achieve an effective throttle area ($A_{eff}$). A throttle actuator (not shown) adjusts the throttle position based on the throttle control signal. The throttle actuator can include a motor or a stepper motor, which provides limited and/or coarse control of the throttle position. The control module 40 also regulates the fuel injection system 20, the cam shaft phasers 32,34 and the EGR system 36 to achieve $T_{REQ}$.

An intake air temperature (IAT) sensor 44 is responsive to a temperature of the intake air flow and generates an intake air temperature signal. A mass airflow (MAF) sensor 46 is responsive to the mass of the intake air flow and generates a MAF signal. A manifold absolute pressure (MAP) sensor 48 is responsive to the pressure within the intake manifold 14 and generates a MAP signal. An engine coolant temperature sensor 50 is responsive to a coolant temperature and generates an engine temperature signal. An engine speed sensor 52 is responsive to a rotational speed of the engine 12 and generates in an engine speed signal. Each of the signals generated by the sensors are received by the control module 40.

The engine torque control system of the present invention determines $A_{eff}$ based on a desired manifold absolute pressure ($P_m$*). In one embodiment, $P_m$* is determined considering the throttle 16 only. In an alternative embodiment, $P_m$* is determined considering the throttle 16, the EGR system 36 and the cam phasers 32,34. When considering the throttle 16 only, the mass of air into the intake manifold ($m_a$) can be determined using the speed density approach according to the following equation:

$$m_a = \frac{\eta_v V_d P_m}{R T_c} \tag{1}$$

where R is the universal gas constant, $V_d$ is the displacement volume of the engine 12, $\eta_v$ is the volumetric efficiency of the engine 12 and $T_c$ is the temperature of the air coming into the intake manifold 14.

Methods of determining ma are disclosed in commonly assigned U.S. patent application Ser. No. 10/664,346, filed Sep. 17, 2003 and entitled Dynamical Torque Control System, and U.S. patent application Ser. No. 10/463,166, filed Jun. 17, 2003 and entitled Model Following Torque Control, the disclosures of which are expressly incorporated herein by reference.

Because $m_a$ is already known, equation (1) can be modified to calculate the desired MAP ($P_m$*) according to the following:

$$P_m^* = \left(\frac{R}{V_d \eta_v}\right) m_a T_c \tag{2}$$

The scaled volumetric efficiency ($V_e$) of the engine 12 is provided as:

$$V_e = \frac{\eta_v V_d}{R} \tag{3}$$

Merging equation (3) into equation (2) provides:

$$P_m^* = \frac{m_a T_c}{V_e} \tag{4}$$

Although $V_e$ can be calculated from equation (3), $V_e$ is a function of $P_m$ and $N_e$. In practice, $V_e$ varies based on several factors including altitude and temperature. To account for this variance, $V_e$ is adapted according to the following relationship:

$$\hat{V}_e = \gamma V_e \tag{5}$$

where $\gamma$ is the ratio of specific heats for air.

In the case where only the throttle 16 is considered, the engine torque control system of the present invention models $V_e$ as a function of $m_a$ and $N_e$. An exemplary model is provided as follows:

$$V_e = k_0 + k_1 N_e + k_2 m_a \tag{6}$$

where $k_0$, $k_1$ and $k_2$ are calibration constants. More specifically, $k_0$, $k_1$ and $k_2$ are determined based on $m_a$ and $N_e$ from a look-up table stored in memory. The look-up table is a two-dimensional table that includes calibration constant values for given engine speed and mass air bands. Each band ranges between a minimum and maximum value. For example, each engine speed band includes a minimum engine speed and a maximum engine speed. The control module 40 selects the calibration constants of the mass air band and the engine speed band that correspond to the current $m_a$ and $N_e$.

When considering the throttle 16, the EGR system 36 and the cam phasers 32,34, $P_m$* is determined according to the following equation:

$$P_m^* = \frac{(m_a + m_{egr})T_c}{V_e} \tag{7}$$

where $m_{egr}$ is the mass of air recirculated by the EGR system and $V_e$ is a function of $P_m$, $N_e$, $\phi_i$ and $\phi_e$. $\phi_i$ and $\phi_e$ are determined by the control module 40 based on the cam phaser positions. In this case, the engine torque control system of the present invention models $V_e$ as a function of $m_a$, $N_e$, $\phi_i$ and $\phi_e$. An exemplary model is provided as follows:

$$V_e = k_o + k_1 N_e + k_2 m_a + k_3 \phi_i + k_4 \phi_e \tag{8}$$

where $k_0$, $k_1$, $k_2$, $k_3$ and $k_4$ are calibration constants. More specifically, $k_0$, $k_1$, $k_2$, $k_3$ and $k_4$ are determined based on $m_a$, $N_e$, $\phi_i$ and $\phi_e$ from a look-up table stored in memory. The look-up table is a multi-dimensional table that is developed similarly as described above with regard to equation (6).

Having determined $P_m$* as described above, the engine torque control system determines $A_{eff}$ according to the following equation:

$$A_{eff} = \frac{\dot{m}_{th}\sqrt{RT_{amb}}}{\Phi} \tag{9}$$

where $\Phi$ is based on a pressure ratio ($P_R$) according to the following relationships:

$$\Phi = \begin{cases} \sqrt{\frac{2\gamma}{\gamma-1}\left(1 - P_R^{\frac{\gamma-1}{\gamma}}\right)} & \text{if } P_R > P_{critical} = \left(\frac{2}{\gamma+1}\right)^{\frac{\gamma}{\gamma-1}} = 0.528 \\ \sqrt{\gamma\frac{2}{\gamma+1}^{\frac{\gamma+1}{(\gamma-1)}}} & \text{if } P_R \le P_{critical} \end{cases} \tag{10}$$

where $P_R$ is the ratio of $P_m$* to the ambient pressure ($P_{amb}$) and $P_{critical}$. $P_{critical}$ is defined as the pressure ratio at which the velocity of the air flowing past the throttle equals the velocity of sound. This condition is called choked or critical flow. The critical pressure ratio is determined by $$P_{CR} = \left(\frac{2}{\gamma+1}\right)^{\frac{\gamma}{\gamma-1}}$$

where $\gamma$=the ratio of specific heats for air and range from about 1.3 to about 1.4.

The engine torque control system determines the value of $P_m$* to produce the desired airflow at the throttle 16. The airflow enables the correct amount of air to enter the cylinders 18 to provide $T_{REQ}$ from the engine 12. Because the control module commands the throttle to a steady-state position, it can be assumed that $\dot{m}_{th}$ is equal to $m_a$. More specifically, during steady-state the flow across the throttle ($\dot{m}_{th}$) is equal to the flow into the cylinders (out of the manifold) ($\dot{m}_a$). Since $A_{eff}$ and $P_m$* are setpoint targets and time is required to reach these values (e.g., approximately 100 ms), it can be approximated that $\dot{m}_{th}$ is equal to $\dot{m}_a$.

Figure 2:
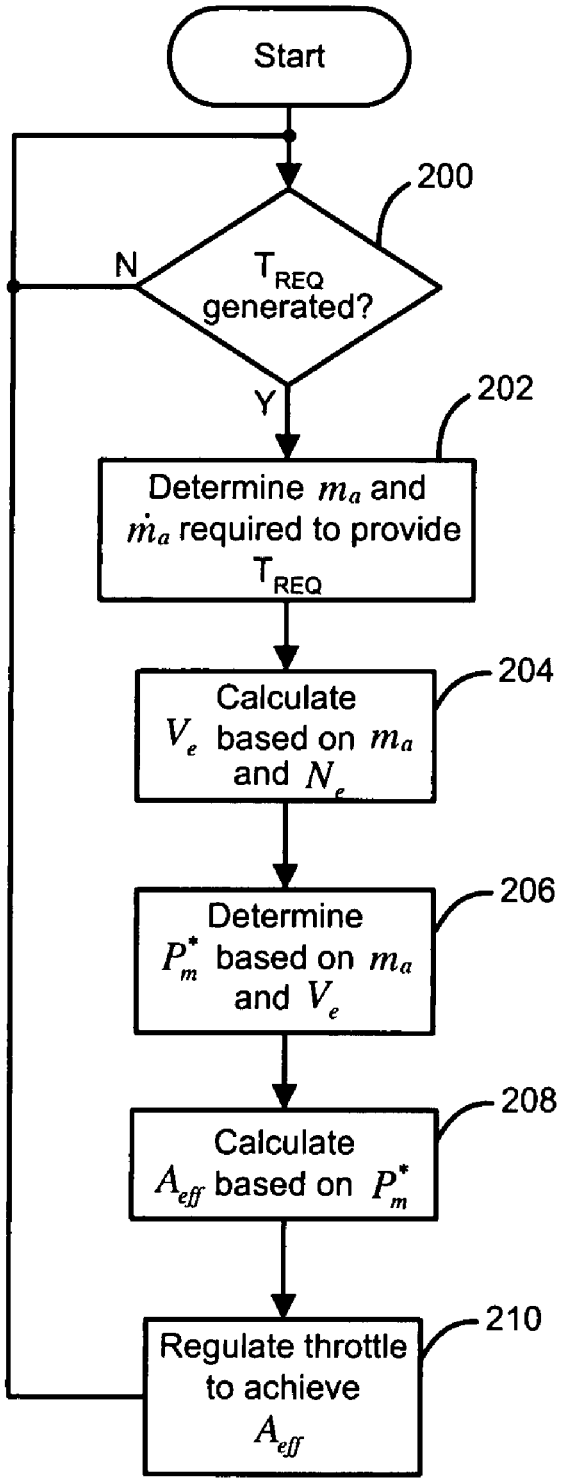
FIG. 2 is a flowchart illustrating steps performed by the engine torque control system of the present invention.

Referring now to FIG. 2, the steps performed by the engine torque control system will be described in detail. In step 200, control determines whether $T_{REQ}$ has been generated. If $T_{REQ}$ has not been generated, control loops back to step 200. If $T_{REQ}$ has been generated, control determines $m_a$ and $\dot{m}_a$ required to achieve $T_{REQ}$ in step 202. In step 204, control calculates $V_e$ based on $m_a$, $N_e$ or $m_a$, $N_e$, $\phi_i$ and $\phi_e$. Control determines $P_m$* based on ma and $V_e$ in step 206. In step 208, control determines $A_{eff}$ based on $P_m$.* Control regulates the throttle to achieve $A_{eff}$ in step 210 and loops back to step 200.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A torque control system for an engine, comprising:

a throttle plate having an adjustable throttle position to regulate a first mass air flow into said engine; and a control module that determines a first mass air flow into said engine, that monitors an engine speed, that calculates a volumetric efficiency of said engine based on said first mass air flow and said engine speed and that calculates said desired MAP based on said volumetric efficiency.

2. The torque control system of claim 1 wherein said volumetric efficiency is further based on calibration coefficients.

3. The torque control system of claim 2 wherein said calibration coefficients are determined based on said engine speed and said first mass air flow.

4. The torque control system of claim 1 further comprising an inlet cam shaft that regulates air flow into a cylinder of said engine, wherein said volumetric efficiency is further based on a phase angle of said inlet cam shaft.

5. The torque control system of claim 1 further comprising an exhaust cam shaft that regulates an exhaust flow from a cylinder of said engine, wherein said volumetric efficiency is further based on a phase angle of said outlet cam shaft.

6. The torque control system of claim 1 wherein said desired MAP is further based on said first mass air flow.

7. The torque control system of claim 6 wherein said desired MAP is further based on a temperature of said first mass air flow.

8. The torque control system of claim 6 further comprising an exhaust gas recirculation (EGR) system that regulates a second mass air flow into said engine, wherein said desired MAP is further determined based on said second mass air flow.

9. A method of determining a desired manifold absolute pressure (MAP) based on an engine torque request of an engine, comprising:

determining a first mass air flow into said engine;

monitoring an engine speed;

calculating a volumetric efficiency of said engine based on said first mass air flow and said engine speed; and calculating said desired MAP based on said volumetric efficiency.

10. The method of claim 9 wherein said volumetric efficiency is further based on calibration coefficients.

11. The method of claim 10 wherein said calibration coefficients are determined based on said engine speed and said first mass air flow.

12. The method of claim 9 wherein said volumetric efficiency is further based on a phase angle of an inlet cam shaft.

13. The method of claim 9 wherein said volumetric efficiency is further based on a phase angle of an outlet cam shaft.

14. The method of claim 9 wherein said desired MAP is further based on said first mass air flow.

15. The method of claim 14 wherein said desired MAP is further based on a temperature of said first mass air flow.

16. The method of claim 14 wherein said desired MAP is further determined based on a second mass air flow into said engine via an exhaust gas recirculation (EGR) system.

17. A method of determining a throttle position, comprising:

determining a first mass air flow into said engine;

monitoring an engine speed;

calculating a volumetric efficiency of said engine based on said first mass air flow and said engine speed;

calculating said desired MAP based on said volumetric efficiency; and calculating said throttle position based on said desired MAP.

18. The method of claim 17 wherein said volumetric efficiency is further based on calibration coefficients.

19. The method of claim 18 wherein said calibration coefficients are determined based on said engine speed and said first mass air flow.

20. The method of claim 18 wherein said volumetric efficiency is further based on a phase angle of an inlet cam shaft.

21. The method of claim 18 wherein said volumetric efficiency is further based on a phase angle of an outlet cam shaft.

22. The method of claim 17 further comprising:

generating an engine torque request; and determining said first mass of air based on said engine torque request.

23. The method of claim 22 wherein said desired MAP is further based on said first mass of air.

24. The method of claim 23 wherein said desired MAP is further based on a temperature of said first mass of air.

25. The method of claim 23 wherein said desired MAP is further determined based on a second mass of air flowing provided by an exhaust gas recirculation (EGR) system.

* * * * *